US010283894B2

(12) United States Patent
Salmons

(10) Patent No.: US 10,283,894 B2
(45) Date of Patent: May 7, 2019

(54) PROTECTION FOR HIGH AMPERAGE CONNECTIONS

(71) Applicant: Larry W. Salmons, Platte City, MO (US)

(72) Inventor: Larry W. Salmons, Platte City, MO (US)

( * ) Notice: Subject to any disclaimer, the term of this patent is extended or adjusted under 35 U.S.C. 154(b) by 0 days.

(21) Appl. No.: 15/725,244

(22) Filed: Oct. 4, 2017

(65) Prior Publication Data

US 2018/0097308 A1 Apr. 5, 2018

Related U.S. Application Data

(60) Provisional application No. 62/403,968, filed on Oct. 4, 2016.

(51) Int. Cl.

| | |
|---|---|
| ***H01R 13/44*** | (2006.01) |
| ***H01R 13/447*** | (2006.01) |
| ***H01R 13/46*** | (2006.01) |
| ***H01R 13/66*** | (2006.01) |
| ***H01R 13/621*** | (2006.01) |
| ***H01R 13/639*** | (2006.01) |
| *H01R 13/58* | (2006.01) |

(52) U.S. Cl.
CPC ..... *H01R 13/447* (2013.01); *H01R 13/465* (2013.01); *H01R 13/6215* (2013.01); *H01R 13/6397* (2013.01); *H01R 13/6691* (2013.01); *H01R 13/582* (2013.01)

(58) Field of Classification Search
CPC .. H01R 25/16; H01R 13/6215; H01R 13/447; H01R 13/465; H01H 71/0257; G08C 17/02; G02B 6/4249
USPC ..... 439/147
See application file for complete search history.

(56) References Cited

U.S. PATENT DOCUMENTS

| | | | | |
|---|---|---|---|---|
| 5,266,760 | A * | 11/1993 | Link | H01H 71/0257 200/244 |
| 2006/0146462 | A1* | 7/2006 | McMillian, IV | G08C 17/02 361/62 |
| 2007/0237470 | A1* | 10/2007 | Aronson | G02B 6/4249 385/101 |
| 2010/0328852 | A1* | 12/2010 | Johnson | H01R 25/16 361/641 |

OTHER PUBLICATIONS

One Source Lift Truck Parts, Spring 2017 Catalog, Cover and pp. 8.25-8.29, Crown Equipment Corporation, New Bremen, Ohio.

* cited by examiner

*Primary Examiner* — Jean F Duverne
(74) *Attorney, Agent, or Firm* — Law Office of Julie Scott LLC

(57) ABSTRACT

The present invention relates to passive restraint devices that are designed to reduce the ability of an operator to gain access to a cable or battery connection before disconnecting the cable from a power supply while simultaneously informing the operator of the inherent dangers present at the cable connection.

1 Claim, 7 Drawing Sheets

PROTECTION FOR HIGH AMPERAGE CONNECTIONS

BACKGROUND OF THE INVENTION

A. Field of the Invention

The present invention relates to the field of electrical power supply. More particularly, the present invention is in the technical field of electrical safety devices and relates to the activation or deactivation of high or medium amperage devices such as batteries, chargers, and the like.

B. Description of the Related Art

In the last 10 to 15 years, industrial, electrical charging has come to rely increasingly on high frequency and fast charging heavy duty batteries. The chargers associated with rapid charging utilize high or medium amperages, making them a comparatively greater electrical hazard than earlier ferroresonant circuits and silicon controlled rectifier (SCR) chargers.

High amperage circuits should be de-energized prior to being connected/disconnected to equipment to minimize the dangers of arc flash, such as injury due to electric shock, burns from high heat, or the failure of electrical equipment parts. Yet safety precautions and instructions regarding the connecting and disconnecting of high and medium amperage sources are not regularly posted at and near such sources to prevent operator errors or negligence. Even when such precautions and instructions are posted, users may not fully recognize the associated dangers. Users are at risk of not remembering or realizing that an amperage source must be de-energized before handling and are at risk of exposure to arc flash or other electrical hazards.

In addition, "hot disconnects" (i.e. severs of energized circuits) can damage equipment and charges, and in some cases, void the warranties for effected equipment. When an electric fault occurs through a hot disconnect, the electrical system is subjected to both thermal and magnetic forces. These forces can severely damage equipment and can be accompanied by fires, explosions, and severe arcing. The costs of repairs, equipment replacements, and medical treatments coupled with lost production and damaged goods can potentially run into millions of dollars in losses.

Furthermore, many connectors for high amperage electrical circuits share a universal design, and the associated couplers for a charger, a battery, and an electric vehicle are often interchangeable, or appear to be interchangeable, with one another. This compatibility can result in a user inadvertently attaching a connector to the wrong receptacle. For example, a connector may be inadvertently attached to the receptacle for an electric vehicle, rather than the receptacle for a battery, so that the battery is not charged. As a result, a forklift battery may fail to charge overnight, and this error can be a costly one due to the loss of production time, and the associated service call needed to put the equipment back into operation.

SUMMARY OF THE INVENTION

The invention provides simple and efficient restraint devices that reduce the ability of an operator to gain access to an electrical, heavy-duty wire, cable connection before disconnecting the heavy-duty cable from a power supply while simultaneously informing the operator of the inherent dangers present at the cable connection.

Advantageously, devices of the invention have an area that can be gripped to disengage large gauge cables from one another without applying a pulling force directly on the cables, and thereby, potentially damaging one or more components within the cables. The force that is applied by a user, generally a pulling or pushing force, is directed at a device of the invention rather than at the cable(s) attached to a connector.

A further advantage of the invention is that it can be used to force an operator to connect a charger coupler to a battery coupler by limiting the operator's connection choices to a single choice. By limiting the operator to a single choice, the operator cannot mistakenly connect a charger coupler to a connector for an electric vehicle (e.g. a forklift or cart) rather than a battery coupler and fail to charge the battery, or mistakenly attempt to "mate" similar-looking connectors that to some appear to be compatible but cannot form a full and complete connection.

Another advantage of the invention is that it is easy to install on a wide variety of electrical chargers and connectors for high amperage electrical circuits. While the exemplary embodiments described and shown in the accompanying figures are connected to the same type of heavy-duty connector (i.e. a 350 Grey), those of skill in the art will appreciate that the invention can be installed on other types of connectors and chargers.

The passive restraint devices of the invention provide a passive restraint placard that is a final touch to a charger installation. Critical information can be taken from a charger's operation manual or OSHA regulations and placed at the user's point of use. By doing so, the opportunity for an operator to making the mistake of plugging a charger into a truck connector can be eliminated. These passive restraint devices serve as safety reminders and continuous recurrent training reinforcements, because the operator must interact with and acknowledge the passive restraint placard in order to connect or disconnect connectors.

The passive restraint devices of the invention also provide a positive link up of charger cables and charger connectors to avoid damage to contact tip and charger cable connections.

Devices of the invention provide handle extensions, and a mechanical advantage for users that experience difficulty in connecting or disconnecting bare connectors.

The passive restraint devices of the invention can include hangar holes that can slide over a mounting peg to keep connectors and charger cables off of the floor and out of harms way.

Commonly, cable connectors are made of hard plastic such as polycarbonate. While they are generally impact resistant, these connectors are often subjected to rough handling that causes them to crack. Those of skill in the art will appreciate that the invention is advantageously designed to provide some protection of such connectors and can reduce losses of such connectors due to cracking or breaking caused by such rough handling. In particular, devices of the invention cover and extend over the portions of connectors that are most likely to crack or break due to impact. In addition, devices of the invention are generally made of materials (e.g. plastics, rubbers, and combinations thereof) that are impact resistant. Devices of the invention may provide a protective guard to shield a user's eyes from arc flash in the event that either a coupler is damaged or the user does not adhere to safe usage.

The invention provides a passive restraint device that the end user must acknowledge and interact with before disconnecting a connector, such as a coupler, from a power source. Advantageously, the invention can include a wide variety of safety warnings, instructions, or other critical information about the electrical connection and power supply that the end user needs for proper use of the connector and to avoid possible personal injury, death, or damage to equipment. Such information and instructions can be included on any exterior portion of the device that is visible to a user.

Optionally, devices of the invention may include a pull handle, hangar, or hangar hole(s) suitable for adding accessories such as a placard with additional instructions or to keep a cable connector off of the floor by sliding the handle or hangar over a mounting peg.

Another advantage of the present invention is that it allows a positive link up of charger cables and charger connectors so that damage due to contact tip, charger cable connection, or a combination thereof can be reduced.

In addition, the invention provides a mechanical advantage to users by effectively providing a handle extension. This handle extension is particularly advantageous in situations where it is difficult to connect and disconnect bare connectors. It provides a better grip for users with smaller hands or lesser arm strength. In addition, the handle extensions or sections of both the top and bottom pieces of a device include protuberances at their bottom ends so that when assembled around an electrical connector, the device with the cable connector mimic the gripping section of a baseball bat and provide a better mechanical advantage from gripping and applying force to connect or disconnect connectors or chargers.

The invention provides passive restraint devices that comprise a front piece, a back piece, one or more fasteners, and a tie strap. The front piece has a handle section having one or more first openings suitable for fasteners and two second openings (i.e. holes) through which to insert the tie strap, and a protector section that is able to cover a junction formed between two joined electrical connectors, or when an electrical connection has not been formed, is able to cover the area where a junction would be formed if a second connector was attached to a first connector to which a device of the invention is attached.

The back piece also has a handle section having one or more first openings suitable for fasteners and two second openings (i.e. holes) through which to insert the tie strap and a protector section that is able to cover a junction formed between two joined electrical connectors, or when an electrical connection has not been formed, is able to cover the area where a junction would be formed if a second connector was attached to a first connector to which a device of the invention is attached.

In devices of the invention, a front piece is attached to a back piece by one or more fasteners through the first openings in the front and back pieces and a tie strap inserted through the holes (i.e. second openings) such that, when an electrical connector is sandwiched between the front piece and the back piece, the assembled device is held firmly against the exterior of the electrical connector, as well as its attached cables, and the junction formed between two joined connectors is covered over by the assembled device, and the junction cannot be accessed without moving a cover section of either a front piece or a back piece of the device.

Preferably, at least the front piece, or alternatively the back piece, of devices of the invention is at least partially flexible so that a user can move the respective protector section and view or access a connector junction area. But, the respective pieces should be sufficiently rigid to prevent inadvertent access to a connector junction area.

Some embodiments of the invention include further safety features. Preferably, passive restraint devices of the invention further comprise one or more alarms. An alarm may be an audible alarm, a visual alarm, or both an audible and visual alarm.

Devices of the invention may further include a magnet, preferably an electromagnet, such that when a device is removed from a connector, the flow of electrical amperage within the cable is disrupted, an alarm is triggered, or a combination thereof occurs.

In some embodiments, the protector sections of the front and back pieces are wider than the handle sections of the respective pieces, and when assembled around an electrical connector, the protector sections cover over and extend laterally at least slightly beyond the lateral edges of the electrical connector. Such embodiments are preferred for restraint devices that are intended to be attached to cable connectors.

Alternatively, the protector sections of the front and back pieces may be similar in width to the handle sections of the respective pieces. Such embodiments are preferred for restraint devices that are intended to be attached to battery connectors. An advantage of providing different embodiments for cable connectors and battery connectors is that users are less likely to inadvertently misconnect a cable connector to a battery connector and prevent a battery from being charged.

To improve the comfort and ease of the handling of devices of the invention, the upper, lateral edges of the handle sections of both front and back pieces can be rolled and slightly thicker than the remainders of the respective handle sections. Similarly, the upper, front edges of the protective sections of both front and back pieces can be rolled and slightly thicker than the remainders of the respective protective sections.

Some preferred embodiments of the invention include one or more mounting spacers on the ventral surface of the back piece. These mounting spacers protrude from one surface (i.e. an interior surface of an assembled device) of the back piece and are intended to nestle into cavities or indentions on a connector that are designed to seat nuts or fasteners that are inserted between the cables that are attached to the connector. These mounting spacers assist in holding a device of the invention firmly in place when attached to a connector. Each mounting spacer includes a hole through which a fastener can be inserted.

Passive restraint devices of the invention include at least one recessed area on the exterior surface of a front piece, a back piece, or a combination thereof that is suitable for the attachment of a label. Such labels can include safety precautions, instructions, or other suitable information. Those of skill in the art will appreciate that the label area does not necessarily need to be recessed; however, by recessing the area, the label and associated information is expected to remain readable for a longer period of time and require less replacement.

To further assist users in gripping a passive restraint device of the invention, the back edge of the handle sections of both front and back pieces is wider laterally than the remainder of the respective handle sections. Increasing the width of these areas increases the available gripping surface area.

Preferred embodiments of the invention, include at least one indicator of electrical current flow on the exterior surface of the front piece so that installation of the device is simplified. These indicators correspond with the indicators that are present on many connectors and are covered when a device of the invention is installed onto a connector. The indicators help to prevent a user from misconnecting electrical cables such that the current flow is reversed.

Embodiments of the invention can also include a mounting hole in either the front piece or the back piece so that devices, and the attached cables, can be hung up off of the floor and out of the way.

Passive restraint devices of the invention include a tie strap or cable strap that is inserted through openings in the handle sections of the front and back pieces of a device such that when a device is assembled the bottom of the handle sections of the front and back pieces are held firmly in contact with the adjacent cables that extend from a connector.

The invention also provides a method of reducing arc flash, electrical shock, or injury that comprises (a) sandwiching an electrical connector between a front piece and a back piece of a passive restraint device, wherein the front piece has a handle section having one or more openings and a protector section; the back piece has a handle section having one or more openings and a protector section; and (b) attaching the front piece to the back piece by one or more fasteners inserted through the one or more openings in the respective handle sections such that the passive restraint device is held firmly against the exterior of the electrical connector and the junction area between two joined connectors is covered over by the respective protector sections of the front and back pieces, and the junction area cannot be accessed without moving the protective section of either the front piece or the back piece of the restraint device.

Those of skill in the art will appreciate that herein electrical connectors or connectors refers to heavy-duty cable connectors or battery connectors that carry high amperage electrical circuits. These connectors are "genderless", meaning that there are no "male" or "female" versions. Instead, these connectors are designed so that they may be either a plug or receptacle. As a result, these connectors can be misconnected to one another to form, or appear to form, a connection.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

DETAILED DESCRIPTION

Figure 1:
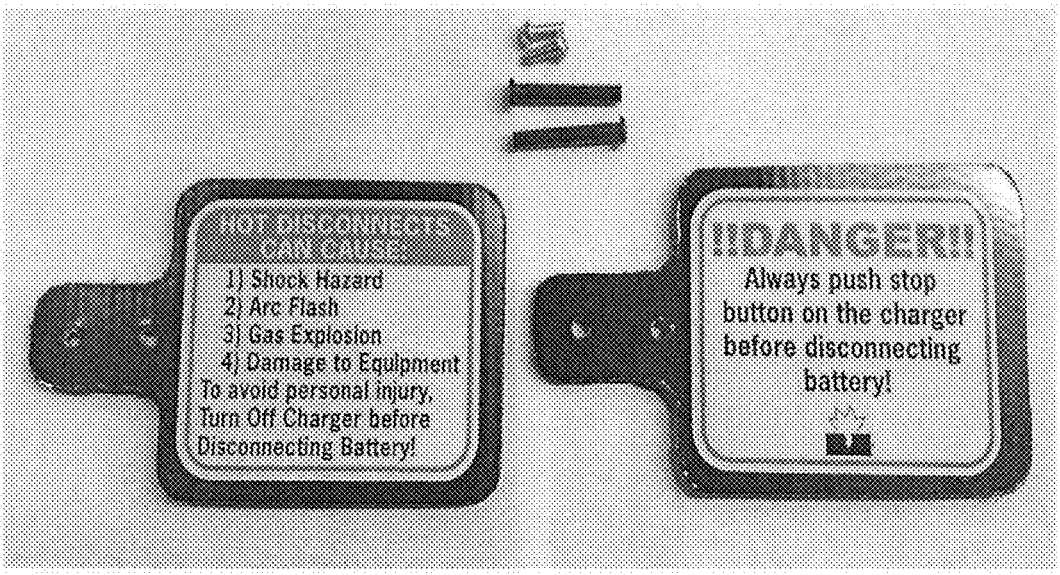
FIG. 1 shows a disassembled embodiment of the invention for covering a connector.

The invention provides simple and efficient restraint devices that reduce the ability of an operator to gain access unsafely to a heavy-duty cable connection before disconnecting the cable from a power supply. The invention also reduces the ability of a user to incorrectly connect compatible, or seemingly compatible, cable connections to each other or to incorrectly attach a cable to an electrical vehicle rather than to a battery charger. In addition, the invention can be used to simultaneously inform the operator of the inherent dangers present at the cable connection or provide other pertinent information.

The invention is a passive restraint device that comprises a front piece and a back piece that are attached to one another by one or more fasteners. Suitable fasteners include screws, rivets, bolts, tacks, twists, clips, clasps, pins, nuts, bolts, or combinations thereof, and the like that are known in the art. Those of skill in the art will appreciate that the screws shown in the accompanying figures are for illustrative purposes and another type of fastener can be substituted for the illustrated screws. Preferred fasteners are those that are not readily removed without the use of a tool (e.g. screwdriver, wrench, etc.) or are not easily dislodged through impact or rough handling. For example, clips or clasps that can be readily removed by hand are less desirable because users may not reassemble the device such that it functionally covers a cable connector(s). Preferred fasteners are those that can be mounted to the the exterior of a connector without contacting the metal parts of the connector; contribute to the insulation properties of the invention; and contribute to providing a rigid connection of the restraint device to the connector.

Preferably, the front piece (see FIGS. 5, 7, 10, and 12) and back piece (see FIGS. 6, 8, 11, and 13) of an embodiment comprise comparatively similar dimensions. Each piece comprises two sections. A handle or first section, i.e. a neck, can be narrowed as compared to the other protector or second section, i.e. restraint cover or cover, that is wider (FIGS. 5-9). Alternatively, the handle sections and protector sections can be of similar widths throughout their lengths (FIGS. 10-13). The neck can include one or more, preferably at least two, first openings (1) of suitable dimensions so that one or more fasteners (2) can be inserted into either a front or back piece and then into or through the corresponding piece of the device such that the front and back pieces are connected to each other. Preferably, the fastening means allows the front and back pieces to be securely attached to each other when an electrical connector or coupler is sandwiched between them. Herein, "sandwiched" refers to the arrangement of an assembled device around a connector such that the connector fits snugly between the front and back pieces of the device and the connector cannot be removed from the assembled device without using force sufficient to damage the connector or its associated cables.

Figure 2:
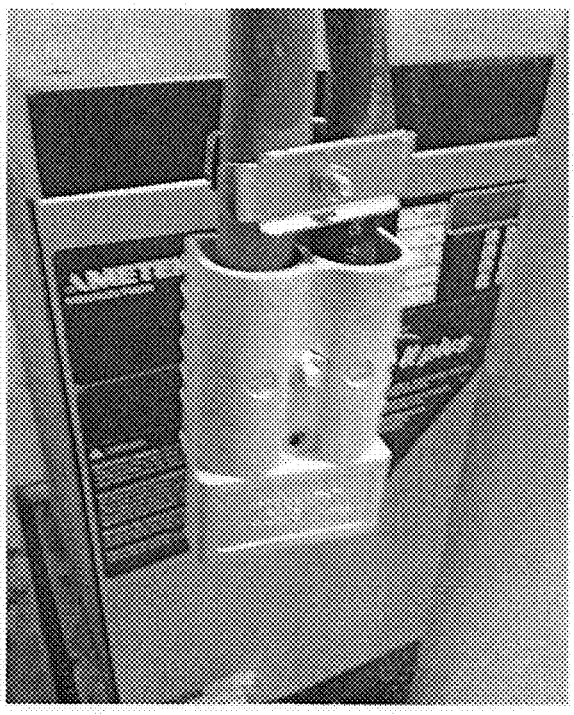
FIG. 2 shows one half of an unconnected connector (a 350 Grey) that is commonly used for high or medium amperage cables.
Figure 3:
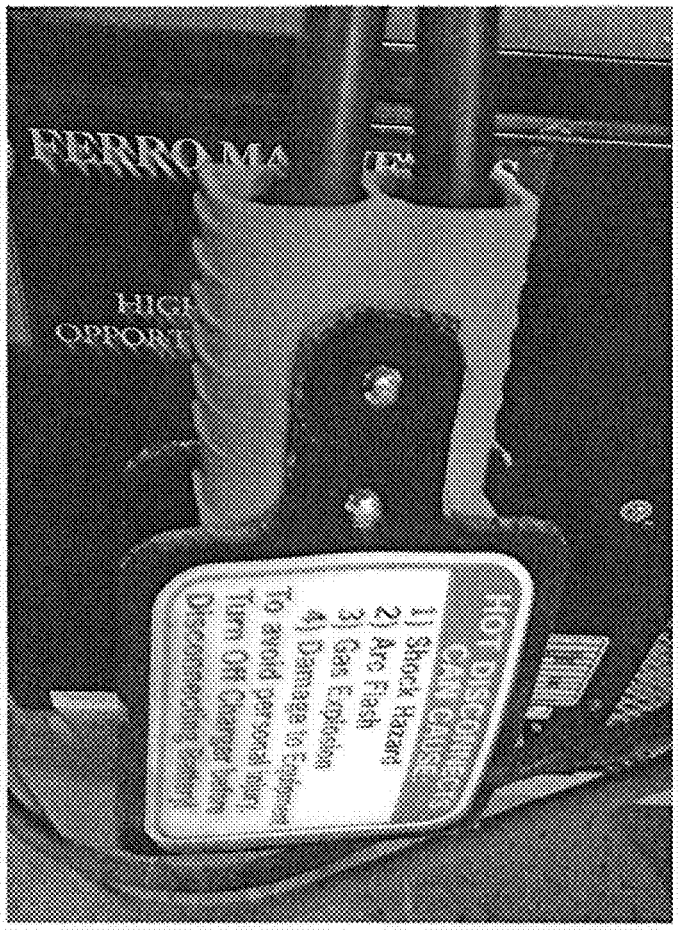
FIG. 3 shows a front view of the embodiment of FIG. 1 installed onto an unconnected half of a connector (a 350 Grey) for high to medium amperage.

The second or protector section of a front or back piece, i.e. the covers, are of sufficient width and length (when viewed from above as in FIG. 1) such that when the device is assembled on or around a coupler (see FIGS. 3 and 4), the coupler cannot be accessed to physically connect or disconnect it from a power cable, charger, battery, or other power source without moving the restraint device. (For comparison, a disconnected coupler without a restraint device is shown in FIG. 2.)

Passive restraint devices comprise a front piece that has a handle section having one or more first openings (1) and two second openings (11) and a protector section that is able to cover a junction formed between two joined electrical connectors; a back piece that has a handle section having one or more first openings (1) and two second openings (11) and a protector section that is able to cover a junction formed between two joined electrical connectors; one or more fasteners (2) that can be a screw, rivet, bolt, tack, twist, clip, clasp, pin, nut, bolt, or combination thereof; and a tie strap, cable strap, or strap (10).

Figure 4:
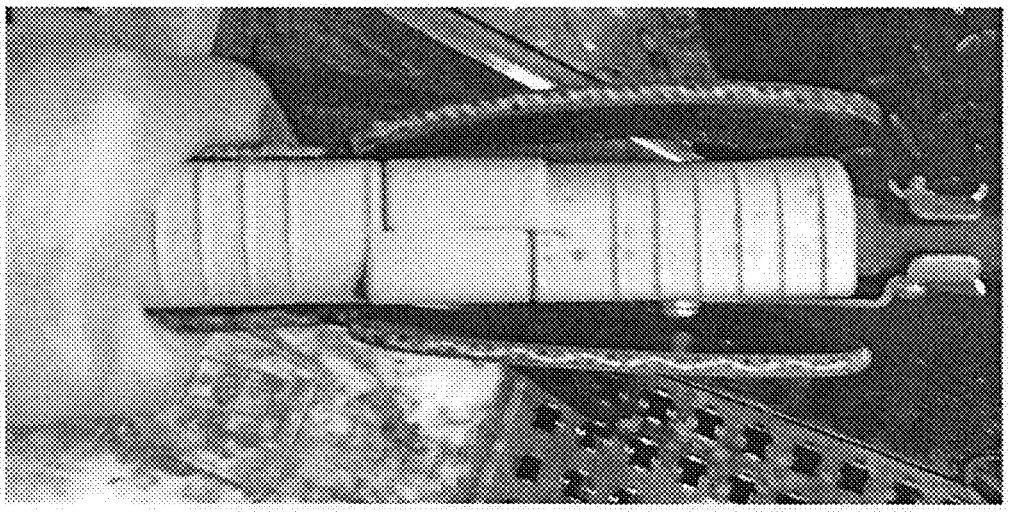
FIG. 4 shows a side view of the embodiment of FIG. 1 installed onto an assembled connector for high to medium amperage.
Figure 5:
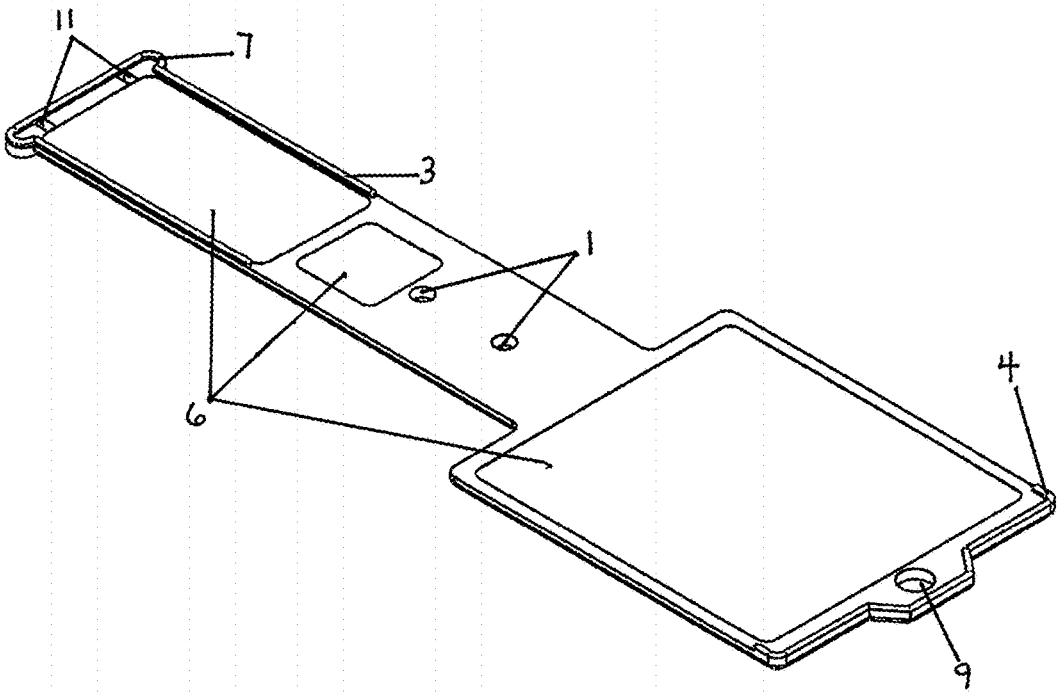
FIG. 5 illustrates a top perspective view of a front piece of a second embodiment of the invention for covering a connector.
Figure 6:
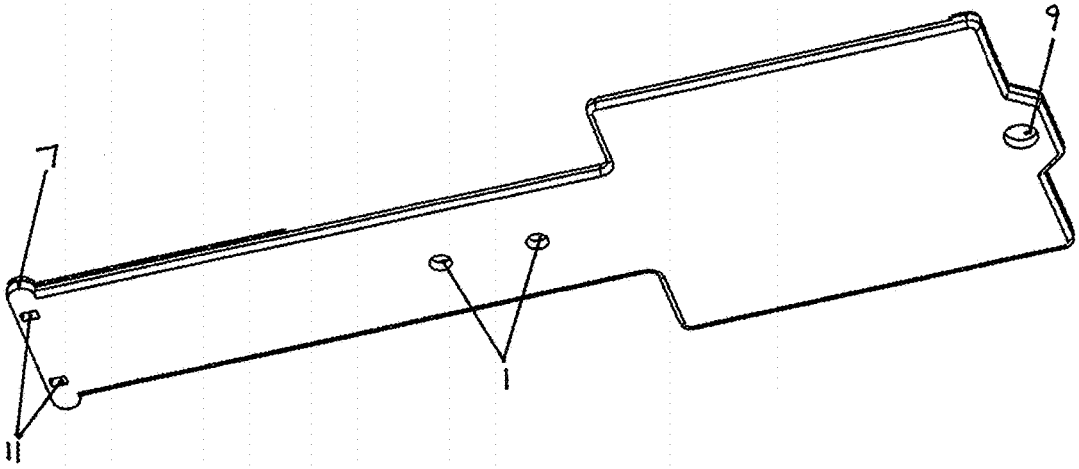
FIG. 6 is a bottom perspective view of a bottom piece of the embodiment illustrated in FIG. 5.
Figure 7:
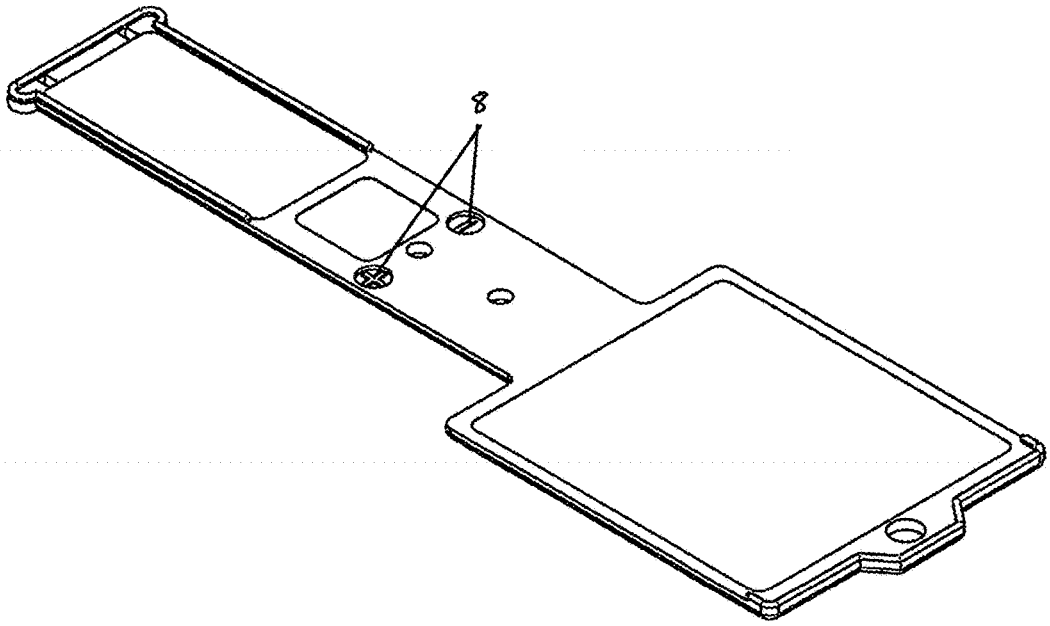
FIG. 7 illustrates a top perspective view of a front piece of a third embodiment of the invention for covering a connector.
Figure 8:
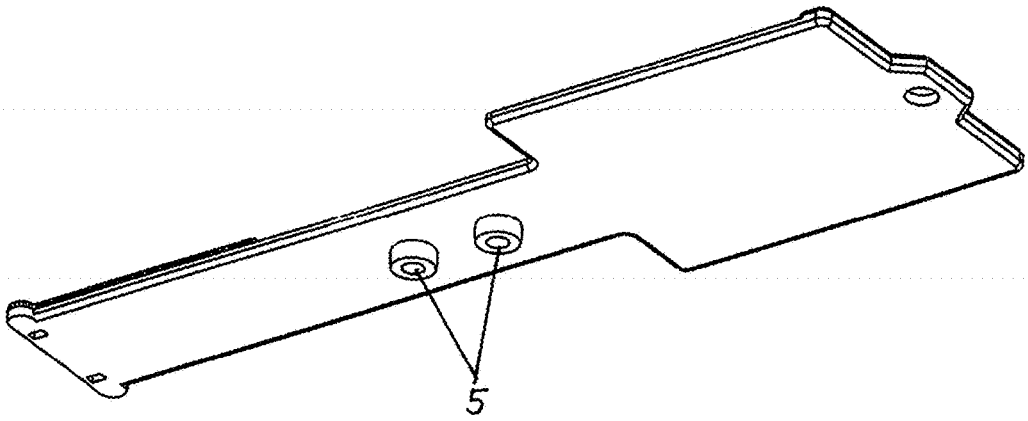
FIG. 8 is a bottom perspective view of a bottom piece of the embodiment illustrated in FIG. 7.
Figure 9:
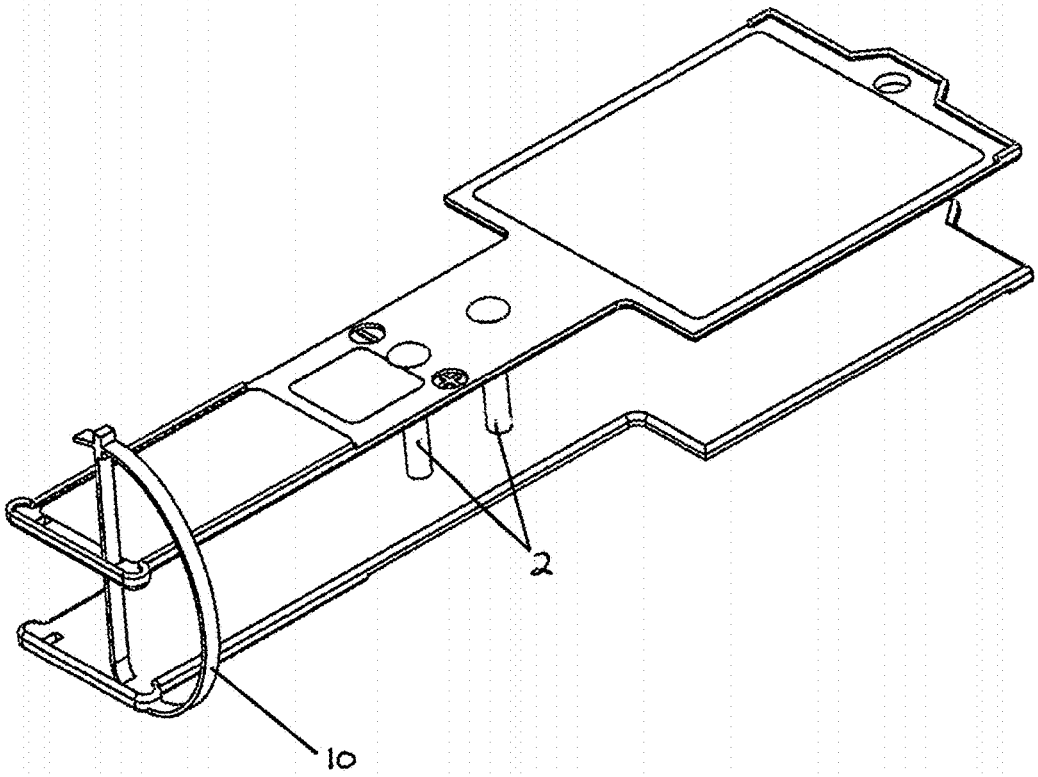
FIG. 9 illustrates the embodiment of FIG. 5 in an assembled configuration without the presence of a connector or cables.
Figure 10:
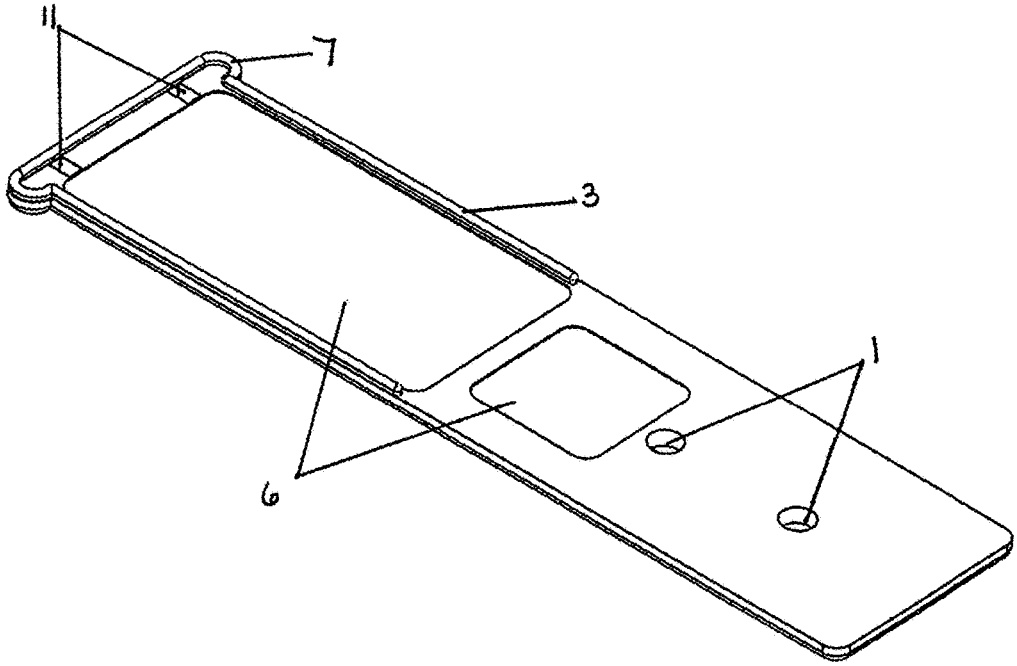
FIG. 10 illustrates a top perspective view of a front piece of an embodiment for covering a battery connector cable.
Figure 11:
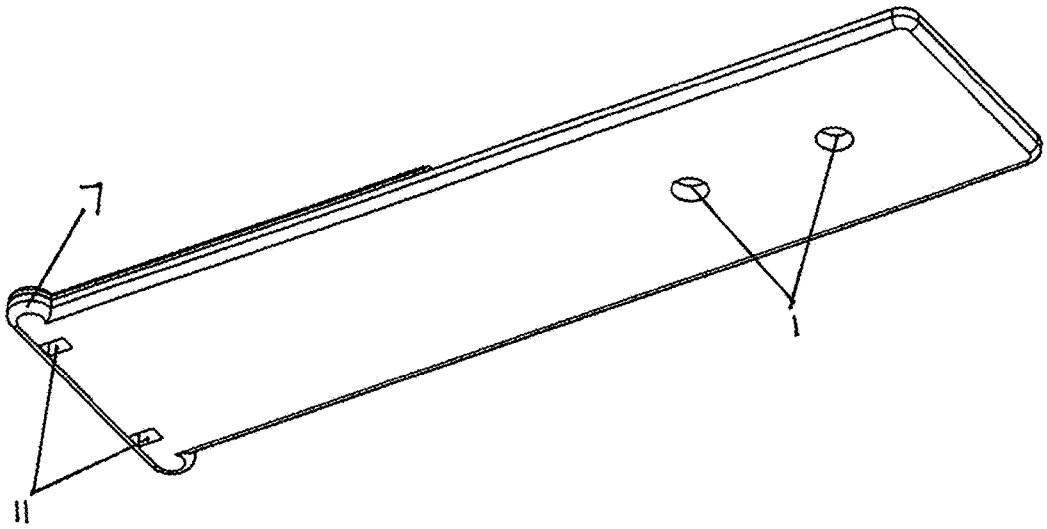
FIG. 11 is a bottom perspective view of the bottom piece of the embodiment illustrated in FIG. 10.
Figure 12:
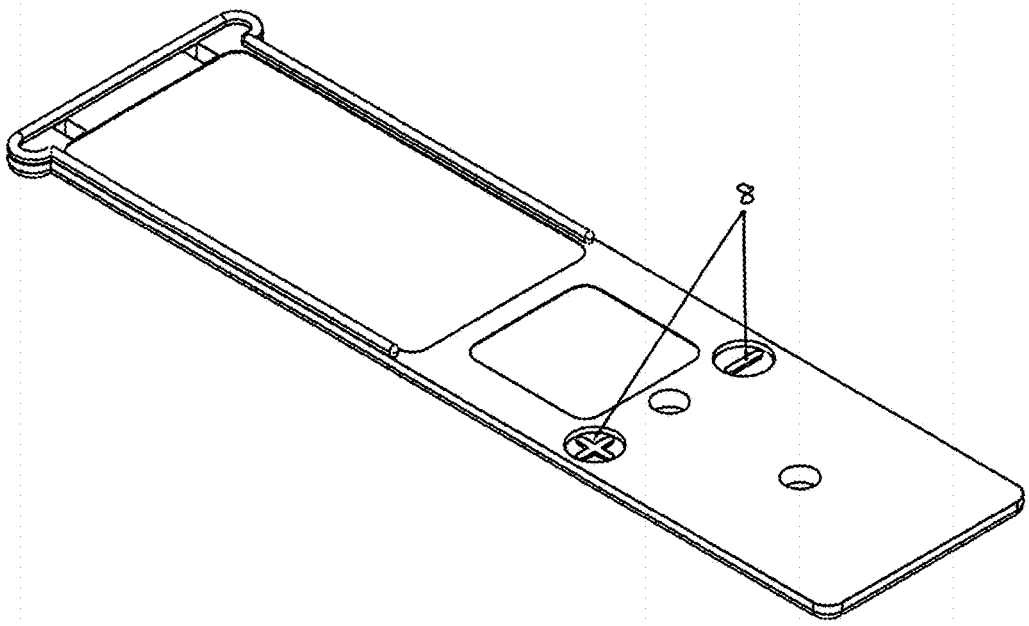
FIG. 12 illustrates a top perspective view of a front piece of another embodiment for covering a battery connector cable.
Figure 13:
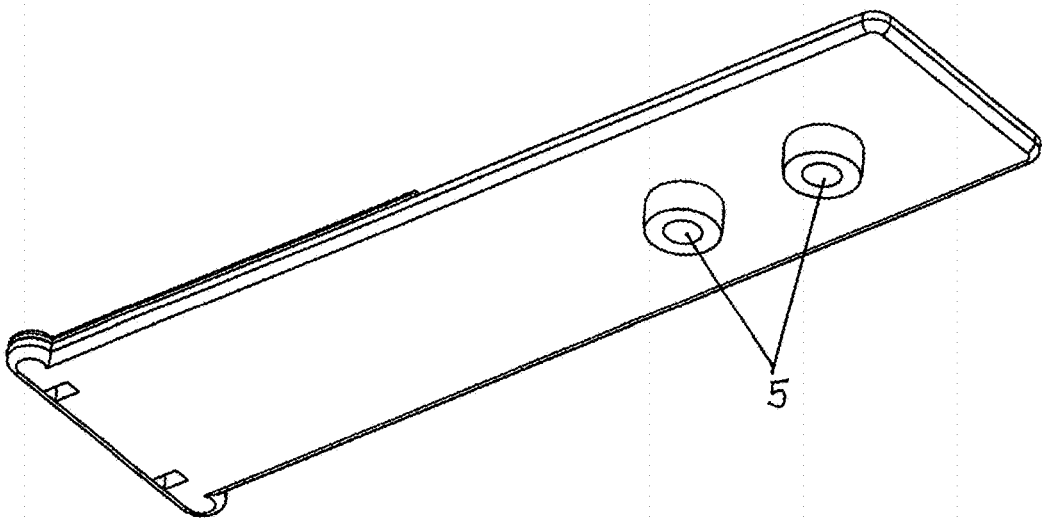
FIG. 13 is a bottom perspective view of the bottom piece of the embodiment illustrated in FIG. 12.

The front piece is attached to the back piece by the one or more fasteners (2) through the first openings (1) in the front and back pieces and by the tie strap (1) through the second openings (11) such that, when an electrical connector is sandwiched between the front piece and the back piece, the assembled device is held firmly against the exterior of the electrical connector and its attached heavy-duty cables such that the junction formed between two joined connectors is covered over by the assembled device and cannot be accessed without moving a cover section of either a front piece or a back piece (see FIGS. 4 and 9).

In an assembled device, a tie strap (10) is inserted through second openings (11) in the respective front and back pieces such that the front and back pieces are attached to each other at the distal end of the handle sections of the front and back pieces (See FIG. 9). Note that in FIG. 9 the tie strap (10) is illustrated as being inserted through a single hole (11) in the front and back pieces. Those of skill in the art will appreciate that in use, the tie strap (10) would be inserted through both holes (11) (i.e second openings) in the front piece as well as the back piece so that the tie strap (10) surrounded the cables extending from a connector attached to the assembled device. When an electrical connector is sandwiched between the front piece and the back piece and the tie strap (1) is tightened, the handle section of the assembled device is held firmly against the cables that extend from the connector.

Preferably, the upper, lateral edges (3) of the handle sections of both front and back pieces are rolled and slightly thicker than the remainders of the respective handle sections. Similarly, the upper, front edges (4) of the protective sections of both front and back pieces are rolled and slightly thicker than the remainders of the respective protective sections.

Preferably, the ventral surface of the back piece includes one or more mounting spacers (5) that protrude from the surface of the back piece and through which one or more fasteners (2) can be inserted. When assembled, these mounting spacers (5) or protuberances nestle into cavities or indentions on a connector that are designed to seat nuts or fasteners that are inserted between the cables that are attached to the connector. These mounting spacers (5) assist in holding a device of the invention firmly in place when attached to a connector and help the device to remain in place even when the assembly is subjected to impact or jarring forces. Each mounting spacer includes a hole through which a fastener (2) can be inserted.

So that safety precautions or other information can be provided to users, the exterior surface of a front or back piece includes at least one recessed area (6) suitable for placing a label containing such precautions or information. The recessed area reduces the wear to the labels that is caused by repeated handling and lengthens the useful life of the device.

To improve the gripping area of the assembled device, the back, lateral edge (7) of the handle sections of both front and back pieces is wider laterally than the remainder of the respective handle sections. This increased lateral width allows for the assembled device with the cable connector to approximate the base of the handle section of a baseball bat, that is, the area for gripping incorporates a ridge or lip that provides mechanical resistance when a pulling force is applied to the assembled device.

Preferably, the front piece of a device includes at least one indicator (8) of electrical current flow on its exterior surface. These indicators (8) mirror those that are commonly found on the exterior of connectors and are intended to prevent a user from reversing an electrical current when making a junction between two connectors. In addition, either the front piece or the back piece can include a mounting hole (9) so that the assembled device and associated cables can be hung up and away from the floor or walking areas.

The thickness of each front and back piece can be varied and depends, at least partially, on the type of material(s) used to construct the restraint device. The pieces should be of sufficient thickness and durability that when assembled the device can withstand multiple attempts by a user to move one of the covers to access a coupler, battery, or charger and then the cover will return to its original position over the coupler.

At least one, and preferably both, of the front and back pieces is flexible. Preferably, the pieces are comprised of plastics, rubbers, composites, or combinations thereof that are non-conductive and of sufficient durability. An entire piece may be flexible or it may be mostly stiff and only flexible at, adjacent to, or near the area where the neck and cover sections meet. A piece has sufficient flexibility such that a user can move a cover to connect or disconnect a coupler without completely removing the restraint device.

The attachment means is suitable for attaching the front and back portions to each other such that sufficient space or area is between the front and back portions so that a connector or coupler can occupy that space or area. The size and length of an attachment means can be varied as desired so that the space or area is larger, wider, or narrower and can be adapted to fit a desired coupler or connector. Preferably, the space is sufficiently large for a connector or coupler to occupy the space, but it is difficult for another object (e.g. a hand or fingers) to simultaneously occupy the space without moving the device.

While not shown in the figures, other embodiments of the invention include additional elements that provide additional features and improvements.

For example, other embodiments of the invention include at least one magnet, preferably an electromagnet, which is attached to the front and back pieces of the device. The magnet comprises two parts. A first magnet part is attached to the front piece of the device, and the second magnet part is attached to the back piece. When the device is attached to a connector, the two parts of the magnet interact with each other to prevent the device from being easily or unintentionally moved. Where the magnet is an electromagnet, the power for the magnet is preferably from the power cable attached to the coupler, and the power must be deactivated for the electromagnet to be released so that the restraint device can be moved to access the connector.

In another embodiment, the device includes one or more audible or visual (e.g. flashing light) alarms that is triggered when a cover is moved. The alarm may be attached either to an inner side (i.e. the side facing the connector), outer side (i.e. the side not facing the connector), or inside a front or back piece of the device. Those of skill in the art will be familiar with the variety of types of alarms and their suitability for use in the invention.

Some embodiments of the device include both a magnet, preferably an electromagnet, and one or more alarms. For example, a restraint device may include an electromagnet that is powered when a coupler is connected to a power cable and prevents the device from being moved until the power is disconnected. When the power is disconnected and the device is moved to disconnect the coupler then an audible, visual, or both audio and visual alarm is triggered. The alarm(s) continues until either the power is restored and the electromagnet functions, or the operator turns the alarm(s) to the OFF position. Those of skill in the art will understand that the power cannot be restored unless the device is put back in place on the coupler, as well as, that setting the alarm(s) to the OFF position can be overridden by restoring the power to the device.

Unless defined otherwise, all technical terms used herein have the same meaning as is commonly understood by one of skill in the art to which this invention belongs at the time of filing. The meaning and scope of terms should be clear; however, in the event of any latent ambiguity, definitions provided herein take precedent over any dictionary or extrinsic definition. Further, unless otherwise required by context, singular terms shall include pluralities and plural terms shall include the singular. For example, the singular forms "a", "an" and "the" include plural referents unless the content clearly dictates otherwise. Herein, the use of "or" means "and/or" unless stated otherwise. Furthermore, the use of the term "including", as well as other forms such as "includes" and "included" is not limiting. Any patents and publications referred to herein are incorporated by reference.

All of the compositions and methods disclosed and claimed herein can be made and executed without undue experimentation in light of the present disclosure. While the compositions and methods of this invention have been described in terms of preferred embodiments, it will be apparent to those of skill in the art that variations may be applied to the compositions and methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the following claims.

What is claimed is:

1. A method of reducing arc flash comprising a) sandwiching an electrical connector between a front piece and a back piece of a passive restraint device, wherein the front piece has a handle section having one or more first openings and two second openings and a protector section; the back piece has a handle section having one or more first openings and two second openings and a protector section; and b) attaching the front piece to the back piece by one or more fasteners inserted through the first openings and by the tie strap inserted through the second openings in the respective handle sections such that the passive restraint device is held firmly against the exterior of the electrical connector and its associated cables, and the junction area between two joined connectors is covered over by the respective protector sections of the front and back pieces, and the junction area cannot be accessed without moving one of the protective sections of either the front piece or the back piece of the restraint device.

* * * * *